US005261481A

United States Patent [19]

Baldwin et al.

[11] Patent Number: 5,261,481

[45] Date of Patent: Nov. 16, 1993

[54] METHOD OF DETERMINING SETBACK FOR HVAC SYSTEM

[75] Inventors: Joe M. Baldwin; John L. Hancock, Jr.; Richard A. Bishop, all of Clarksville, Tenn.

[73] Assignee: American Standard Inc., New York, N.Y.

[21] Appl. No.: 976,591

[22] Filed: Nov. 13, 1992

[51] Int. Cl.[5] ..... F28F 27/00

[52] U.S. Cl. ..... 165/2; 165/11.1; 165/12; 236/46 R

[58] Field of Search ..... 165/2, 11.1, 12, 26, 165/27; 236/46 R

[56] References Cited

U.S. PATENT DOCUMENTS

| | | | |
|---|---|---|---|
| 4,313,560 | 2/1982 | Stiles | 236/46 |
| 4,347,974 | 9/1982 | Pinckaers et al. | 236/46 |
| 4,373,351 | 2/1983 | Stamp, Jr. et al. | 62/160 |
| 4,411,306 | 10/1983 | Kabat | 165/12 |
| 4,446,913 | 5/1984 | Krocker | 165/12 |
| 4,522,336 | 6/1985 | Culp | 236/46 R |
| 4,620,668 | 11/1986 | Adams | 236/46 |
| 4,632,177 | 12/1986 | Beckey | 165/12 |
| 4,674,027 | 6/1987 | Beckey | 364/143 |
| 4,702,305 | 10/1987 | Beckey et al. | 165/12 |
| 4,733,719 | 3/1988 | Levine | 165/12 |
| 4,751,961 | 6/1988 | Levine et al. | 165/12 |
| 4,898,230 | 2/1990 | Tsuchiyama et al. | 165/12 |
| 5,025,984 | 6/1991 | Bird et al. | 236/46 |
| 5,192,020 | 3/1993 | Shah | 165/12 X |

*Primary Examiner*—John Rivell

*Attorney, Agent, or Firm*—William J. Beres; William O'Driscoll; Peter D. Ferguson

[57] ABSTRACT

A method of air conditioning an environment with an HVAC system. The method comprises the steps of: determining an environment to be either occupied or vacant; determining a mode of operation for the HVAC system to be heating or cooling; determining a heating setpoint and a cooling setpoint; and determining a setback value equal to a difference between the value of the heating setpoint and the value of the cooling setpoint. The method also includes the steps of: establishing an operational setpoint equal to the heating setpoint if the mode of operation in the environment is heating and the environment is occupied; establishing an operational setpoint equal to the heating setpoint minus the setback value if the mode of operation is heating and the environment is unoccupied; establishing an operational setpoint equal to the cooling setpoint if the mode of operation is cooling and the environment is occupied; establishing an operational setpoint equal to the cooling setpoint plus the setback value if the mode of operation is cooling and the environment is unoccupied; and conditioning the environment in accordance with the operational setpoint.

18 Claims, 2 Drawing Sheets

METHOD OF DETERMINING SETBACK FOR HVAC SYSTEM

DESCRIPTION

BACKGROUND OF THE INVENTION

The present invention is directed to an improved method of determining setback or setup in heating, ventilating and air conditioning systems (HVAC).

Setback and setup are mechanisms for saving energy during unoccupied time periods by establishing an unoccupied setpoint farther from the comfort zone than an occupied setpoint. Since the unoccupied setpoint is farther from the comfort zone, less work is required by the HVAC equipment when the unoccupied setpoint is used. Generally setback refers to lowering the heating setpoint, while setup refers to increasing the cooling setpoint. For purposes of the present invention and for brevity in explanation, setback will be used to refer to both setback and setup, and the direction of setback will depend upon whether heating or cooling is the mode of operation.

Previously, setback systems would add a fixed increment such as 4° F. to the cooling setpoint to establish an unoccupied setpoint, or subtract a fixed increment such as 4° F. from a heating setpoint to establish a setback temperature. Although this approach does save energy, under most conditions more energy can be saved by using more flexible strategies. Flexible strategies are particularly appropriate where an occupant is willing to tolerate greater extremes of temperature, or where the area to be cooled is a warehouse or the like which is unoccupied most of the time. In such situations, much energy can be saved by increasing the amount of setback in proportion to an areas lack of occupancy or in proportion to indications of a user's tolerance for temperature extremes.

In a setback system controlled by a time clock system, the time clock system provides a control signal whenever setback is desired and for as long as setback is desired. Typically, a control signal is provided only when setback is desired.

SUMMARY OF THE INVENTION

It is an object, feature and an advantage of the present invention to improve upon prior art setback systems for heating, ventilating and air conditioning systems.

It is an object, feature and an advantage of the present invention to allow an occupant to easily control the amount of setback.

It is an object, feature and an advantage of the present invention to allow an occupant of an HVAC system having a cooling setpoint and a heating setpoint to easily control the amount of setback by adjusting the position of the non-active setpoint.

It is an object, feature and an advantage of the present invention to allow an occupant of an HVAC system having cooling and heating setpoints to adjust the amount of setback by varying the range between the cooling and the heating setpoints.

It is an object, feature and an advantage of the present invention to ensure that a setback system has a minimum default setback temperature.

It is an object, feature and an advantage of the present invention to allow a time clock system to indicate via a sensor line or an input terminal that the area being sensed by the sensor is unoccupied or occupied.

The present invention provides a method of air conditioning an environment with an HVAC system. The method includes the steps of: determining an environment to be either occupied or vacant; determining a mode of operation for the HVAC system to be heating or cooling; determining a heating setpoint and a cooling setpoint; and determining a setback value equal to a difference between the value of the heating setpoint and the value of the cooling setpoint. The method also includes the steps of: establishing an operational setpoint equal to the heating setpoint if the mode of operation in the environment is heating and the environment is occupied; establishing an operational setpoint equal to the heating setpoint minus the setback value if the mode of operation is heating and the environment is unoccupied; establishing an operational setpoint equal to the cooling setpoint if the mode of operation is cooling and the environment is occupied; establishing an operational setpoint equal to the cooling setpoint plus the setback value if the mode of operation is cooling and the environment is unoccupied; and conditioning the environment in accordance with the operational setpoint.

The present invention also provides a method of air conditioning a zone. The method comprises the steps of: determining the cooling setpoint of the zone; determining the heating setpoint of the zone; determining the mode of operation of the zone; and determining, responsive to the mode of operation determining step, which setpoint is active and which setpoint is inactive; determining an unoccupied setpoint by subtracting the value of the inactive setpoint from twice the value of the active setpoint. The method also comprises the steps of: monitoring the temperature of the zone; determining the occupancy of the zone; controlling the flow of conditioned air to the zone during the occupied periods in accordance with the difference between the zone temperature and the active setpoint; and controlling the flow of conditioned air to the zone during unoccupied periods in accordance with the difference between the zone temperature and the unoccupied setpoint.

The present invention further provides an HVAC system comprising: an air conditioning unit; at least one zone to be conditioned by the air conditioning unit; a sensor providing a temperature measurement in the zone to be conditioned; means for determining the operational mode of the air conditioning unit, the cooling setpoint of the zone, the heating setpoint of the zone, and the occupancy status of the zone to be conditioned; and a controller responsive to the determining means and the sensor. The controller includes first means for establishing an operational setpoint in the heating mode which is equal to the heating setpoint if the zone is occupied and which is equal to the heating setpoint minus the difference between the cooling setpoint and the heating setpoint if the zone is unoccupied, and; second means for establishing an operational setpoint in the cooling mode which is equal to the cooling setpoint if the zone is occupied and which is equal to the cooling setpoint plus the difference between the cooling setpoint and a heating setpoint if the zone is unoccupied.

DETAILED DESCRIPTION OF THE DRAWINGS

Figure 1:
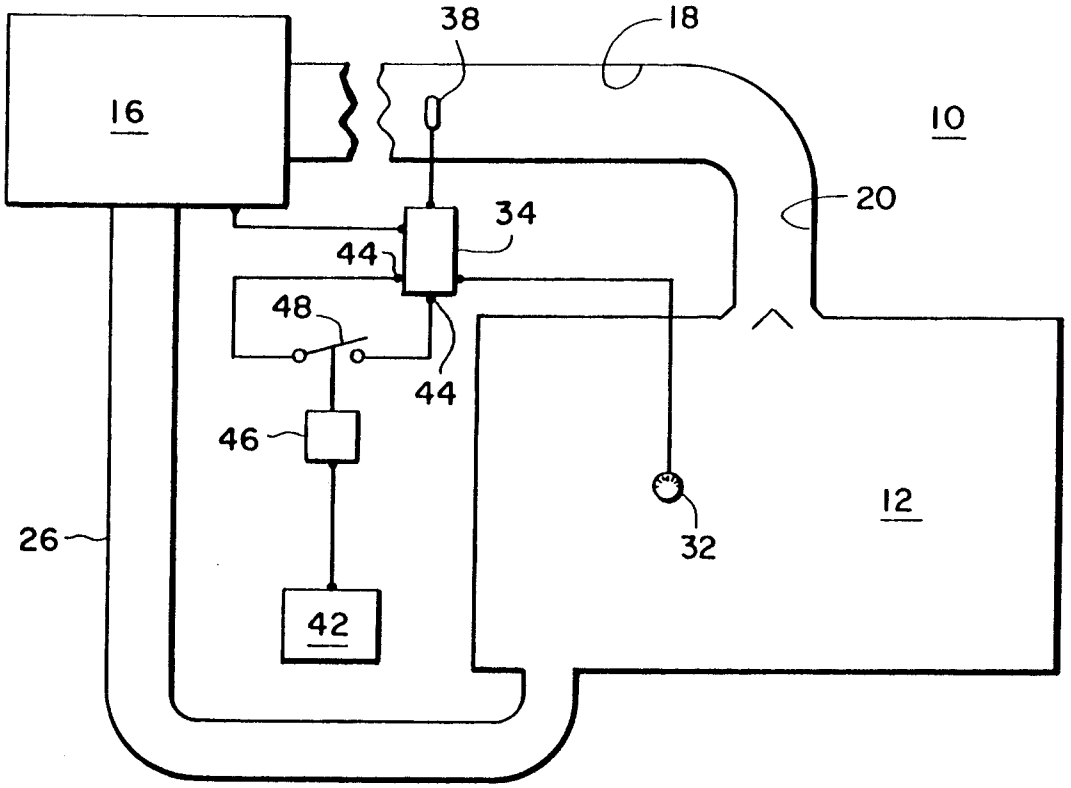
FIG. 1 shows an HVAC system suitable for use with the present invention.

FIG. 1 shows an HVAC system 10 for a zone 12. Heat flows to and from the zone 12 through a series of heat transfer operations. During normal cooling operation, heat enters the zone 12 from internal sources such as people, lights and equipment, and from external sources such as infiltration through walls, conduction through walls and radiation through windows. The zone is cooled by supply air provided from a source 16 of variable temperature supply air such as a water chiller air conditioning system, a heat pump air conditioning system, a packaged gas/electric rooftop air conditioning system or the like. The conditioned supply air is conveyed from the source 16 by a duct to the zone 12. Similarly, during normal heating operation, heat is provided from the source 16 of conditioned air by means of the duct 18 and the branch duct 20 to the zone 12. A return air duct 26 is provided to return air from the zone 12 to the source 16 for reconditioning. Alternatively, return air can be mixed with supply air and returned to the zone 12. The basic objective of the air distribution system 10 is to add or subtract heat by means of the conditioned supply air to the zone 12 so that the net amount of heat gained, lost, and stored within the zone 12 is balanced at a comfortable temperature.

To control the temperature of the air provided to the zone 12, a controller 34 is operably connected to and controlling the source 16 of conditioned air. The controller 34 is also operably connected to a sensor 32 located in the zone 12. The sensor 32 reports zone temperature, mode of operation, and zone setpoints for heating and cooling to the controller 34. The controller 34 compares the temperature of the zone 12 to the operating setpoint (SETPOINT) and determines a desired mode of operation for the zone 12. The term "operating setpoint" is used herein to indicate which of the following setpoints is currently being used by the controller 34: the cooling setpoint (CSP), the unoccupied cooling setpoint (SETUP), the heating setpoint (HSP), and the unoccupied heating setpoint (SETBACK). If the mode of operation is cooling, the operating setpoint is the cooling setpoint, while if the mode of operation is heating the operating setpoint is the heating setpoint. During unoccupied heating or cooling periods, the heating setpoint or the cooling setpoint is respectively setback or set up to the unoccupied heating setpoint or the unoccupied cooling setpoint. The controller 34, by means of the source 16, supplies heated or cooled supply air varying in temperature from 55° F. through as high as 140° F. based on the requirements of the zone 12 as determined by the operating setpoint.

The present invention is directed to allowing an occupant to conveniently alter the operating setpoint during periods of unoccupancy so that the HVAC system 10 does less work when the zone 12 is determined to be unoccupied and the heating or cooling setpoints have been respectively replaced by the unoccupied heating or cooling setpoints. Occupancy can be indicated in a number of ways preferably including an external time clock system 42 but also by an occupancy sensor (not shown) or a computer program (not shown). The time clock system 42 interfaces to a pair of inputs 44 of the controller 34 to indicate occupied or unoccupied status of the zone 12 by means of a coil 46 and a normally open switch 48. Each time the time clock system 42 issues a signal indicating unoccupancy, the coil 46 is energized to close the normally open switch 48. This shorts the inputs 44 and indicates to the controller 34 that the occupancy state should be changed from occupied to unoccupied because the time clock system 42 is calling for setback. Once the unoccupied state is recognized, the controller 34 sets back the operating setpoint from the occupied setpoint to an unoccupied setpoint in accordance with the graph of FIG. 2 and the flow chart shown in FIG. 3. In the preferred embodiment, an open input 44 input indicates occupied conditions in the zone 12 and a shorted input 44 indicates unoccupied setback conditions in the zone 12. Alternatively, a person of ordinary skill in the art will recognize that the coil 46 could be arranged to energize a normally closed switch 48. In this alternative, an open input 44 indicates an unoccupied setback condition in the zone 12 while a shorted input 44 indicates an occupied condition in the zone 12.

Figure 2:
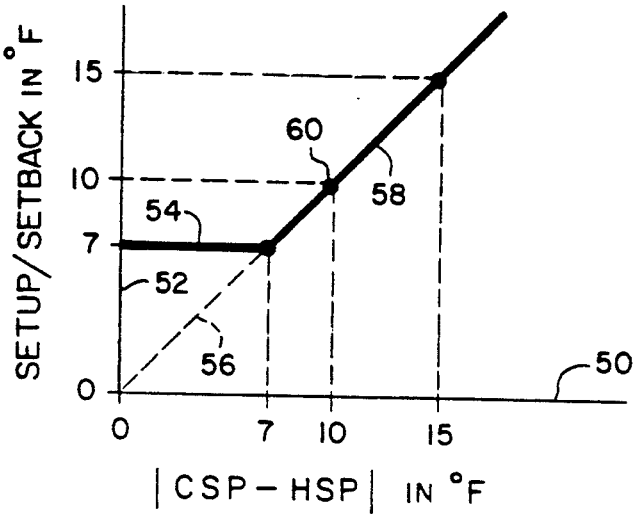
FIG. 2 shows a graph illustrating how the amount of setback or setup is determined in accordance with the present invention.

The graph of FIG. 2 shows how the amount of setback is determined. The ordinate 50 of the graph is determined by the absolute value of the cooling setpoint (CSP) minus the heating setpoint (HSP) in degrees Fahrenheit, while the abscissa 52 of the graph shows the actual amount of setback (or setup) in degrees Fahrenheit. The horizontal line 54 indicates a default amount of setback of 7° F. which is the minimum amount of setback or setup allowed in the preferred embodiment. The dashed line 56 between 0° and 7° F. of setback illustrates that the present invention would provide no setback under certain conditions if a default amount such as that shown by the line 54 were not required. The line 58 shows how the difference between the cooling setpoint (CSP) and the heating setpoint (HSP) is used to linearly increase the amount of setback or setup in accordance with a user's alteration of the inactive setpoint. Since only one setpoint can be actively used by the HVAC system 10 depending on whether beating or cooling mode of operation is in effect, an occupant can freely adjust the position of the inactive setpoint. Effectively, a great range between the active and the inactive setpoints, e.g. the cooling setpoint and the heating setpoint, is taken as an indication that a greater amount of setback is desired in the zone 12.

For example, the point 60 illustrates the situation where a cooling setpoint of 78° F. has been set and a heating setpoint of 68° F. has been set. Since the difference between the cooling setpoint and heating setpoint is greater than the default amount of 7° F., the amount of setback is determined to be 10° F. by subtracting the heating setpoint from the cooling setpoint. Consequently if the cooling mode of operation was active and the zone 12 unoccupied as indicated by the input 44, the operational setpoint, i.e. the unoccupied cooling setpoint, would be increased by 10° to 88° F. Conversely, if the heating mode of operation were active and the zone 12 unoccupied as indicated by the input 44, the operational setpoint, i.e. the unoccupied heating setpoint, would be decreased by 10° F. to 58° F. Much greater energy savings are provided by the linearly increasing approach of the preferred embodiment of the present invention when compared with previous setback systems. However, a person of ordinary skill in the art will recognize many linear and non-linear variations of the present invention, all of which are contemplated as equivalents to the invention as claimed herein. One such variation is represented by the formula setback = C*|CSP−HSP| where C is a real number or an algebraic expression.

Figure 3:
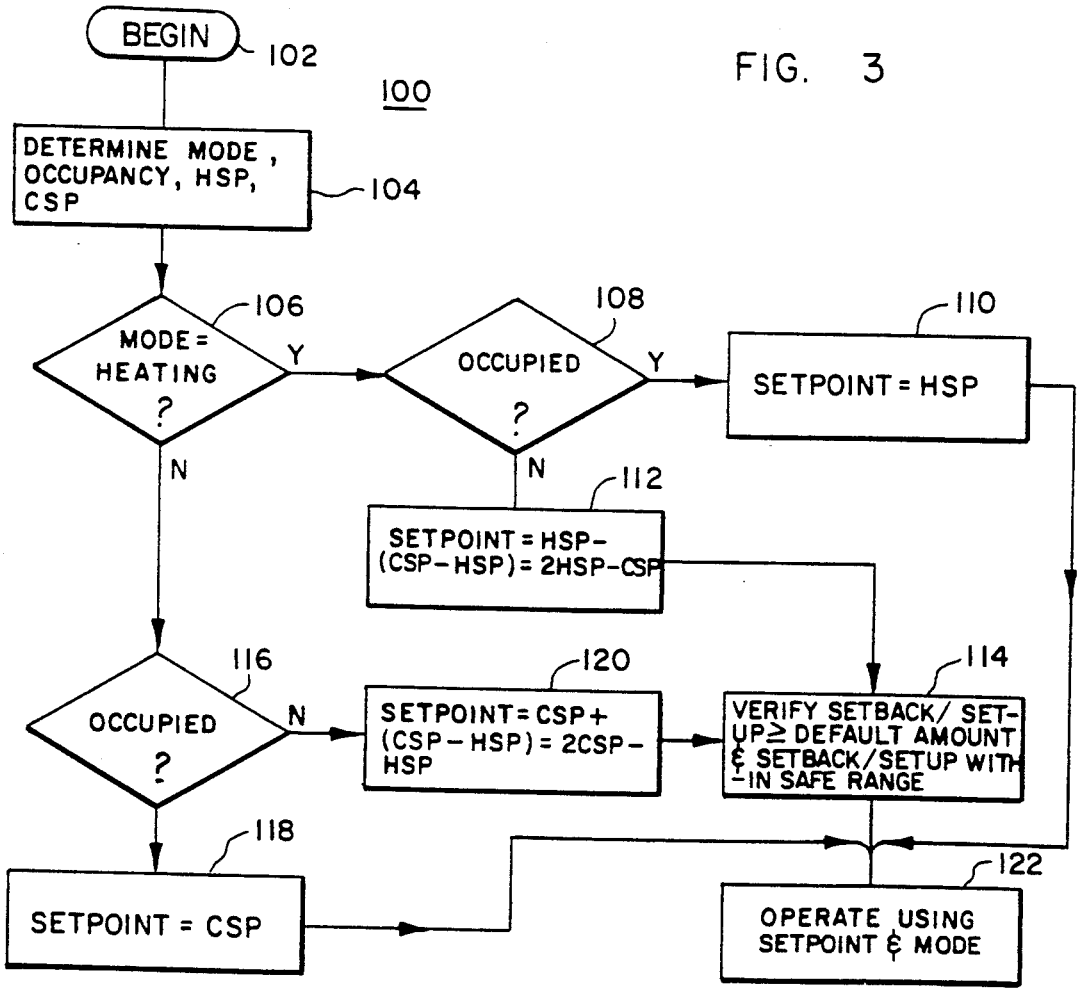
FIG. 3 is a flow chart illustrating the preferred embodiment of the present invention in accordance with FIG. 2.

FIG. 3 is a flow chart routine 100 illustrating the preferred embodiment of the present invention shown in FIG. 2. The routine 100 is periodically entered at step 102. At an initialization step 104 the routine 100 determines the mode of operation to be either heating or cooling, and exits the routine 100 if the mode is neither. The initialization step 104 also determines the heating setpoint HSP, and the cooling setpoint CSP. Additionally, the validity of all inputs preverified and a default value is substituted for any invalid inputs. If a default value is used, setback is not implemented and only the following steps 106, 110, 118 and 122 are used.

At step 106 the mode of operation is determined. If the mode of operation is heating then, at step 108, a determination is made as to whether the zone 12 is in the occupied state as determined by an open on the inputs 44. If the zone 12 is occupied, the operating setpoint (SETPOINT) is set equal to the heating setpoint (HSP) at step 110. However if the zone 12 is unoccupied as determined by a short at the inputs 44, then, at step 112 the operating setpoint (SETPOINT) is determined to be the heating point less the difference between the cooling setpoint and the heating setpoint. This is shown by the following formulas:

$$\text{SETPOINT} = \text{HSP} - (\text{CSP-HSP})$$
$$\text{SETPOINT} = 2\text{HSP} - \text{CSP}$$

At step 114, the amount of setback or setup is verified to be at least equal the default amount of setback/setup (7° F. in the preferred embodiment) and also determined to be within a safe range such that the operating setpoint is kept above freezing and below a predetermined upper limit which can be empirically determined.

If the mode of operation was determined at step 106 to be cooling, a determination is made at step 116 as to whether or not the zone 12 is occupied. If the zone is occupied as determined by an open on the inputs 44, the operating setpoint (SETPOINT) is set equal to the cooling setpoint CSP at step 118. However if the zone 12 is not occupied as determined by a short on the inputs 44, the operating setpoint (SETPOINT), at step 120, is set equal to the cooling setpoint plus the difference between the cooling setpoint and the heating setpoint. This is illustrated by the following formulas:

$$\text{SETPOINT} = \text{CSP} + (\text{CSP-HSP})$$
$$\text{SETPOINT} = 2\text{CSP} - \text{HSP}$$

The amount of setback is again verified at step 114 to determine that the default minimum setback or setup is met (7° F. in the preferred embodiment) and that the operating setpoint is within a safe operating range for the HVAC system 10. The routine 100 then ends and the HVAC system 10 operates conventionally as shown at step 122 using the current mode of operation and whatever operating setpoint (SETPOINT) was determined at the appropriate step 110, 114, 118 or 120.

What has been illustrated is an HVAC system which adjusts to the amount of setback or setup in accordance with the user's tolerance or in accordance with the normal occupancy status of the area to be conditioned. It will be apparent that many alterations and modifications are possible. Once such readily apparent modification is to reverse the signals from the time clock system so that a short indicates an occupied state and an open indicates an unoccupied state. Another modification is the application of the present invention to a VAV system instead of the constant volume system described above. All such modifications and alterations are intended to be within the scope of the invention as embodied in the following claims.

We claim:

1. A method of air conditioning an environment with an HVAC system comprising the steps of:

a) determining an environment to be either occupied or vacant;

b) determining a mode of operation for the HVAC system to be heating or cooling;

c) determining a heating setpoint and a cooling setpoint;

d) determining a setback value equal to a difference between the value of the heating setpoint and the value of the cooling setpoint;

e) establishing an operational setpoint equal to the heating setpoint if the mode of operation in the environment is heating and the environment is occupied;

f) establishing an operational setpoint equal to the heating setpoint minus the setback value if the mode of operation is heating and the environment is unoccupied;

g) establishing an operational setpoint equal to the cooling setpoint if the mode of operation is cooling and the environment is occupied;

h) establishing an operational setpoint equal to the cooling setpoint plus the setback value if the mode of operation is cooling and the environment is unoccupied; and i) conditioning the environment in accordance with the operational setpoint.

2. The method of claim 1 including the further steps of:

comparing the setback value to a minimum default value;

setting the setback value to be the minimum default value if the setback value is less than the minimum default value.

3. The method of claim 2 wherein the setback value determining step (d) includes the further step of multiplying the setback value by a constant C where C is a real number or an algebraic expression.

4. The method of claim 3 wherein the occupied determining step (a) includes the further step of receiving a signal generated by a time clock system.

5. The method of claim 3 wherein the occupied determining step (a) includes the further step determining occupancy either by an occupancy sensor or a time based computer program.

6. The method of claim 3 including varying the setback value with changes in the value of the cooling setpoint if the mode of operation is heating and varying the setback value with changes in the value of the heating setpoint if the mode of operation is cooling.

7. The method of claim 1 wherein the setback value determining step (d) includes the further step of multiplying the setback value by a constant C where C is a real number or an algebraic expression.

8. The method of claim 1 including varying the setback value with changes in the value of the cooling setpoint if the mode of operation is heating and varying the setback value with changes in the value of the heating setpoint if the mode of operation is cooling.

9. A method of air conditioning a zone comprising the steps of:

determining the cooling setpoint of the zone;

determining the heating setpoint of the zone;

determining the mode of operation of the zone;

determining, responsive to the mode of operation determining step, which setpoint is active and which setpoint is inactive;

determining an unoccupied setpoint by subtracting the value of the inactive setpoint from twice the value of the active setpoint;

monitoring the temperature of the zone;

determining the occupancy of the zone;

controlling the flow of conditioned air to the zone during the occupied periods in accordance with the difference between the zone temperature and the active setpoint; and controlling the flow of conditioned air to the zone during unoccupied periods in accordance with the difference between the zone temperature and the unoccupied setpoint.

10. The method of claim 9 wherein the occupancy determining step includes the further step of receiving a signal generated by a time clock system.

11. The method of claim 9 wherein the unoccupied setpoint determining step includes the further step of setting a minimum default amount of difference between the unoccupied setpoint and the active setpoint.

12. The method of claim 11 including the further steps of monitoring the inactive setpoint and redetermining the unoccupied setpoint if the inactive setpoint is modified.

13. The method of claim 9 including the further steps of monitoring the inactive setpoint and redetermining the unoccupied setpoint if the inactive setpoint is modified.

14. An HVAC system comprising:

an air conditioning unit;

at least one zone to be conditioned by the air conditioning unit;

a sensor providing a temperature measurement in the zone to be conditioned;

means for determining the operational mode of the air conditioning unit, the cooling setpoint of the zone, the heating setpoint of the zone, and the occupancy status of the zone to be conditioned; and a controller responsive to the determining means and the sensor, the controller including first means for establishing an operational setpoint in the heating mode which is equal to the heating setpoint if the zone is occupied and which is equal to the heating setpoint minus the difference between the cooling setpoint and the heating setpoint if the zone is unoccupied, and;

second means for establishing an operational setpoint in the cooling mode which is equal to the cooling setpoint if the zone is occupied and which is equal to the cooling setpoint plus the difference between the cooling setpoint and a heating setpoint if the zone is unoccupied.

15. The HVAC system of claim 14 wherein the determining means includes a coil for opening or closing an input to the controller.

16. The HVAC system of claim 15 including a time clock system operably controlling the coil.

17. The HVAC system of claim 16 further including means, responsive to the cooling setpoint during the heating mode and responsive to the heating setpoint during the cooling mode, for adjusting the operational setpoint.

18. The HVAC system of claim 14 further including means, responsive to the cooling setpoint during the heating mode and responsive to the heating setpoint during the cooling mode, for adjusting the operational setpoint.

* * * * *